US009963980B2

(12) United States Patent
Negri et al.

(10) Patent No.: US 9,963,980 B2
(45) Date of Patent: May 8, 2018

(54) TURBOMACHINE ROTOR BLADE

(71) Applicant: SNECMA, Paris (FR)

(72) Inventors: Arnaud Negri, Moissy-Cramayel (FR); Romain Bard, Moissy-Cramayel (FR); Slim Bensalah, Moissy-Cramayel (FR); Alexandre Gimel, Moissy-Cramayel (FR); Thomas Lardellier, Missy-Cramayel (FR); Denis Gabriel Trahot, Moissy-Cramayel (FR)

(73) Assignee: SNECMA, Paris (FR)

( * ) Notice: Subject to any disclaimer, the term of this patent is extended or adjusted under 35 U.S.C. 154(b) by 291 days.

(21) Appl. No.: 14/764,757

(22) PCT Filed: Jan. 23, 2014

(86) PCT No.: PCT/FR2014/050129
§ 371 (c)(1),
(2) Date: Jul. 30, 2015

(87) PCT Pub. No.: WO2014/118456
PCT Pub. Date: Aug. 7, 2014

(65) Prior Publication Data

US 2015/0369058 A1 Dec. 24, 2015

(30) Foreign Application Priority Data

Feb. 1, 2013 (FR) ..... 13 50887

(51) Int. Cl.
*F01D 5/22* (2006.01)
*F01D 5/28* (2006.01)
*F01D 11/08* (2006.01)

(52) U.S. Cl.
CPC ..... *F01D 5/286* (2013.01); *F01D 5/225* (2013.01); *F01D 5/288* (2013.01); *F01D 11/08* (2013.01);
(Continued)

(58) Field of Classification Search
CPC . F01D 5/225; F01D 5/28; F01D 5/286; F01D 5/288; F01D 11/08; F01D 11/12;
(Continued)

(56) References Cited

U.S. PATENT DOCUMENTS 4,155,152 A * 5/1979 Cretella ..... B23P 6/007 29/402.18
4,822,248 A * 4/1989 Wertz ..... B23P 6/007 29/402.07
(Continued)

FOREIGN PATENT DOCUMENTS

EP 0927814 7/1999
EP 1936119 6/2008
(Continued)

OTHER PUBLICATIONS

French Search Report, dated Nov. 18, 2013, French Application No. 1350887.
(Continued)

*Primary Examiner* — Mark Laurenzi
*Assistant Examiner* — Xiaoting Hu
(74) *Attorney, Agent, or Firm* — Womble Bond Dickinson (US) LLP

(57) ABSTRACT

A turbomachine rotor blade, said blade having, at the distal end thereof, a heel comprising: a platform (2) having a first edge (201) on the lower side and a second edge (202) on the upper side, at least one sealing member having a first end portion (301) on the lower side and a second end portion (302) on the upper side, said sealing member having a sealing top that extends radially outwards from said platform (2) between said first and second end portions (301, 302), characterized in that, for at least one sealing member, the heel (105) comprises, on at least at one of the edges (201, 202), a portion forming a bowl (5) extending along the end
(Continued)

portion (301, 302) of the sealing member which corresponds to the edge (201, 202), the portion forming the bowl (5) being suitable for receiving a deposit of anti-wear material.

9 Claims, 6 Drawing Sheets

(52) U.S. Cl.
CPC ..... *F05D 2220/30* (2013.01); *F05D 2230/14* (2013.01); *F05D 2230/30* (2013.01); *Y10T 29/49339* (2015.01)

(58) Field of Classification Search
CPC ..... F01D 11/122; F01D 11/127; F05D 2230/30–2230/314; F05D 2220/30; F05D 2230/14
See application file for complete search history.

(56) References Cited

U.S. PATENT DOCUMENTS 5,372,861 A * 12/1994 Kerrand ..... C23C 4/12 427/556
8,918,995 B2 * 12/2014 Milleville ..... B23P 6/002 148/527
2004/0124231 A1 * 7/2004 Hasz ..... B23K 35/3046 228/245
2005/0120555 A1 * 6/2005 Boudereau ..... B23K 9/044 29/889.1
2008/0145207 A1 * 6/2008 Mohr ..... F01D 5/225 415/173.1
2009/0202344 A1 * 8/2009 Bruce ..... F01D 5/225 415/198.1
2013/0259699 A1 * 10/2013 Collin ..... F01D 5/225 416/224

FOREIGN PATENT DOCUMENTS

| | | |
|---|---|---|
| FR | 2970999 | 8/2012 |
| GB | 2294951 | 5/1996 |
| JP | 2004150272 | 5/2004 |

OTHER PUBLICATIONS

International Search Report and Written Opinion with English Translation, dated Mar. 19, 2014, Application No. PCT/FR2014/050129.

* cited by examiner

TURBOMACHINE ROTOR BLADE

FIELD OF THE INVENTION

The invention relates to a rotor blade of a turbomachine. The invention also relates to a method for depositing anti-wear material on a rotor blade of the turbomachine.

PRIOR ART

There exist rotor blades of turbomachines, comprising a lower side and an upper side, positioned on either side of a blade stacking axis. Such a blade is for example a blade of a turbine stage. Referring to FIG. 1, such blades have, at their distal end 103, a heel 105.

Each heel 105 includes a platform 2 having a first edge 201 on the lower side and a second edge 202 on the upper side. Each heel 105 includes at least one seal lip 3 having a first end portion 301 on the lower side and a second end portion 302 on the upper side. The seal lip 3 is for example capable of cooperating with a stator lining, for example an abradable lining, so as to limit friction between the blade and a shroud concentric with the rotor.

The seal lip 3 has a seal lip top extending radially outward from said platform 2 between said first 301 and second 302 end portions. By radial direction is meant a direction orthogonal to an axis of the turbomachine.

At its proximal end 102, the blade includes for example a root 104 by which it is attached to a disc of the rotor of the turbomachine. Several movable blades can be attached to a rotor disc, their heels 105 being then positioned edge to edge so as to form a circumferential ring. One such circumferential ring makes it possible to delimit on the outside a gas flow passage passing through the turbomachine and thus to limit possible gas leaks.

In order to damp the vibrations to which the blades are subject in operation, the blades are mounted on their rotor disc with a torsional stress about their stacking axis. By stacking axis is meant the axis passing through the center of gravity of the lowest section of the blade, that is the one closest to the proximal end, and orthogonal to the axis of the turbomachine.

Thus the platforms 2 of the heels 105 are designed so that each blade is given a torsional stress by pressing against its neighbors, mainly along said second portions of the lateral edges 201 and 202. To improve the mutual support of the blades and, in particular, to avoid straddling of the heels 105 and to transmit as well as possible the stress from one blade to its neighbors, it is known to provide, along the first edge 201 and/or the second edge 202, between the two end portions 301 and 302 of the two seal lips 3 and 4, a profile having three portions forming a "Z," the central part of the "Z" having a protruding edge. This edge is designed to receive a layer of anti-wear material to protect the heel 105 from friction with the adjacent blade.

The deposit of the anti-wear material is done conventionally on the rough casting. However, the quantity to be deposited is relatively small and the surface to be deposited the smallest possible so as not to increase the mass of the blade and so as to limit the quantity of material used. It is thus common for overflows to occur during deposition of the anti-wear material, and that the overflows persist after machining the blade. It is then necessary to remove the overflows by manually retouching the blade. However, such a manual retouching step remains difficult, given the small dimensions of the edge and of the deposit. In addition, such a step is expensive, on the one hand, because it makes the manufacturing method of the blade more complex and prolongs it—additional checking steps being necessary—and on the other hand because it generates a considerable number of rejects.

Moreover, such a heel 105 must have particular profile and a protruding edge, which also involves more complicated manufacturing for the rough part.

SUMMARY OF THE INVENTION

One aim of the invention is to compensate these shortcomings.

To this end, there is provided a rotor blade of a turbomachine, said blade having at its distal end a heel including:

- a platform having a first edge on the lower side and a second edge on the upper side,
- at least one seal lip having a first end portion on the lower side and a second end portion on the upper side, said seal lip having a seal lip top extending radially outward from said platform between said first and second end portions, for at least one seal lip, the heel including on at least one of its edges, a portion forming a cup extending along the end portion of the seal lip which corresponds to the edge, the portion forming a cup being designed to receive a deposit of anti-wear material.

The invention is advantageously complemented by the following features, alone or in any one of their technically possible combinations:

- a layer of anti-wear material deposited in each cup thus formed;
- the heel includes, for at least one seal lip, at the first, respectively second edge, a first, respectively second portion forming a cup extending along the first, respectively second end portion of the seal lip, the first, respectively second, portion forming a cup being designed to receive a deposit of anti-wear material;
- each portion forming a cup includes two walls extending on either side of the corresponding end portion of seal lip, the walls forming the lateral edges of the cup and the end portion of the seal lip forming the bottom of the cup;
- an upstream seal lip and a downstream seal lip;
- the anti-wear material is of the Stellite type;
- the blade is a rough blade part before machining;
- the blade is a machined blade.

The invention further relates to a method for depositing anti-wear material on a rotor blade of a turbomachine, including the steps consisting of:

- supplying such a rough part of a rotor blade of a turbomachine,
- depositing a layer of anti-wear material in each cup formed, and
- machining the walls of the cup extending past the layer of anti wear material deposited, Furthermore, the method can include a step consisting of sanding the surface of the anti-wear layer and of the portion forming a machined cup, so as to make them smooth.

BRIEF DESCRIPTION OF FIGURES

Other features and advantages of the invention will be revealed in the description hereafter of one embodiment. In the appended drawings.

DETAILED DESCRIPTION OF THE INVENTION

Example of a Blade

General Structure of the Blade

Figure 1:
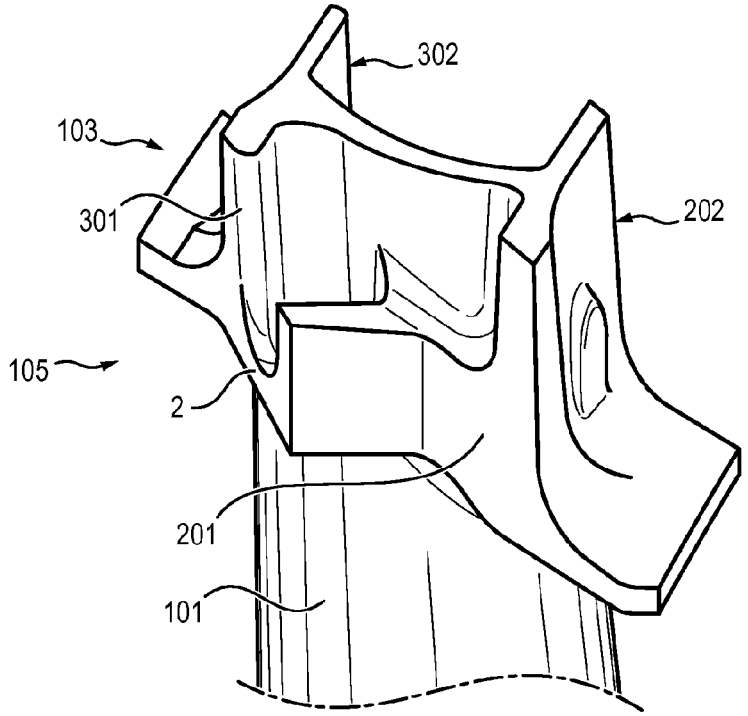
FIG. 1 (prior art)
FIG. 1 shows a detail of a rotor blade of a turbomachine according to the prior art.
Figure 2:
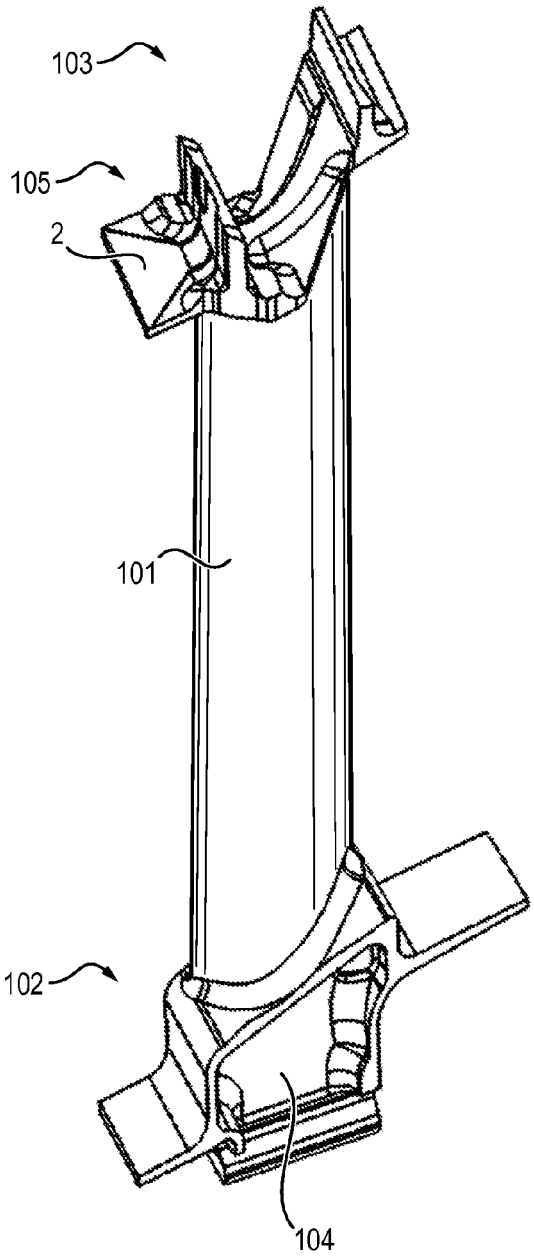
FIG. 2 shows a rotor blade of a turbomachine according to an example of an embodiment of the invention.
Figure 3A:
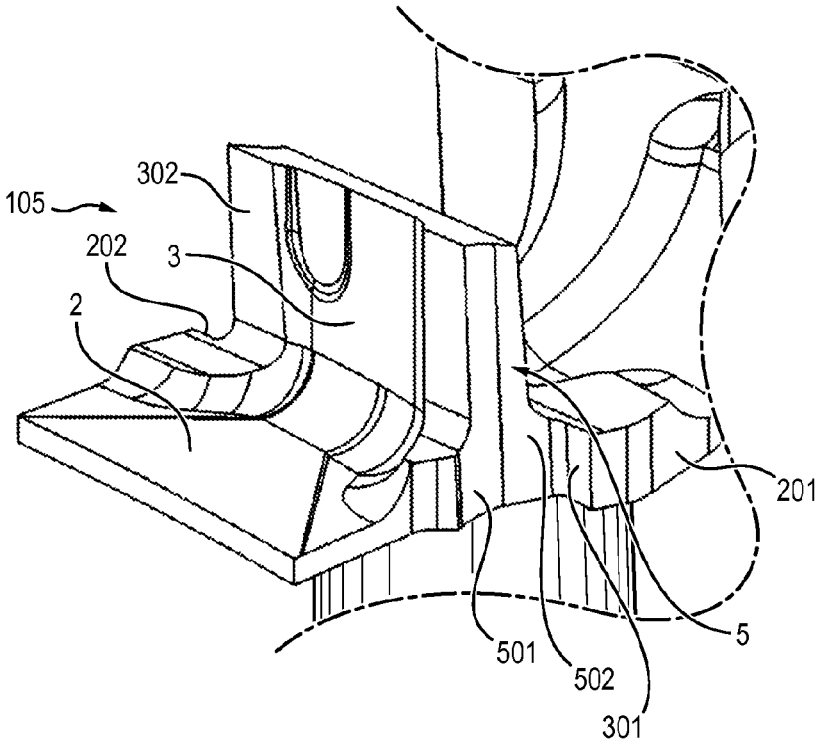
FIG. 3*a* shows a seal lip of the blade of FIG. 2 without the deposit of anti-wear material.
Figure 3B:
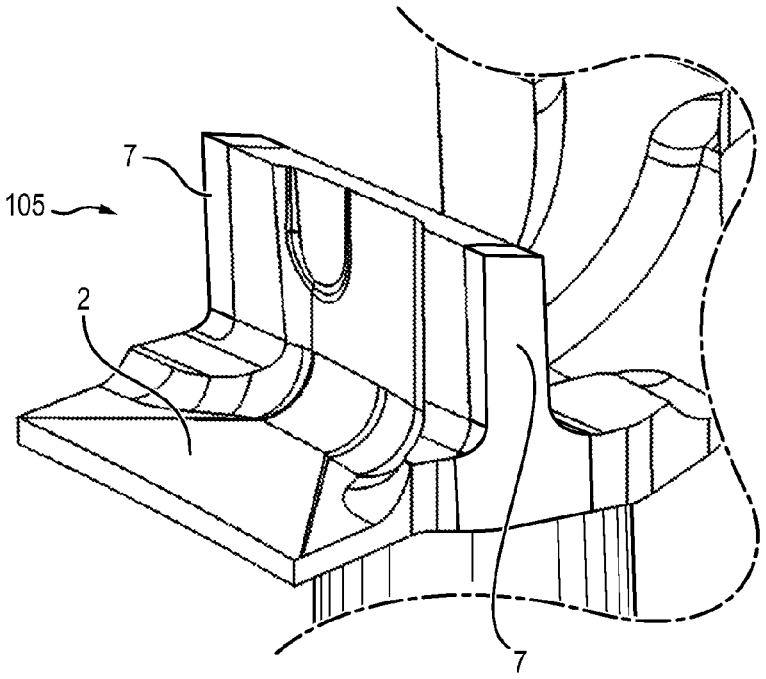
FIG. 3*b* shows the seal lip of FIG. 3*a* with the deposit of anti-wear material.
Figure 4A:
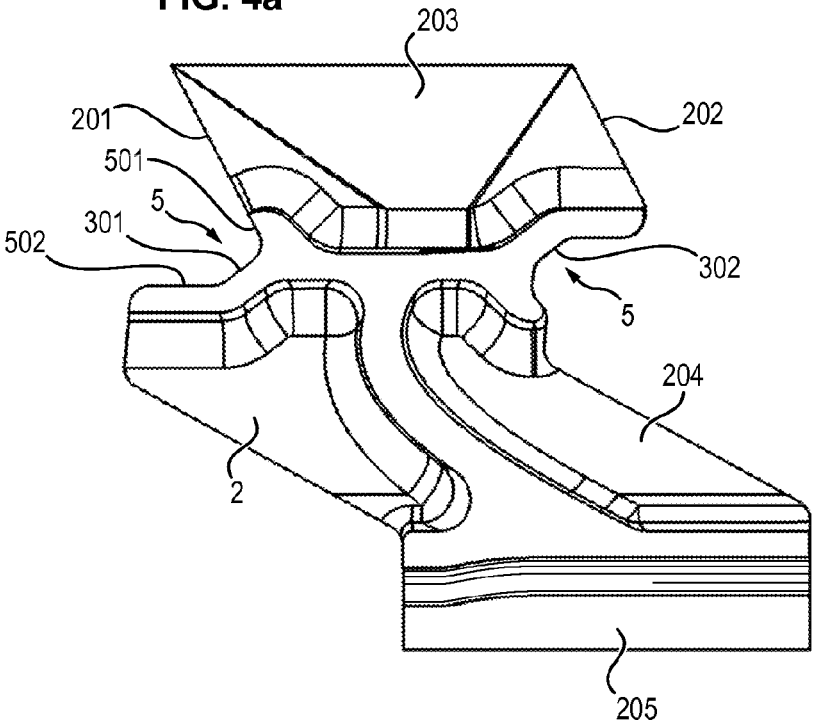
FIG. 4*a* shows a view along a radial axis of the heel of a rough rotor blade part according to an example of an embodiment of the invention.
Figure 4B:
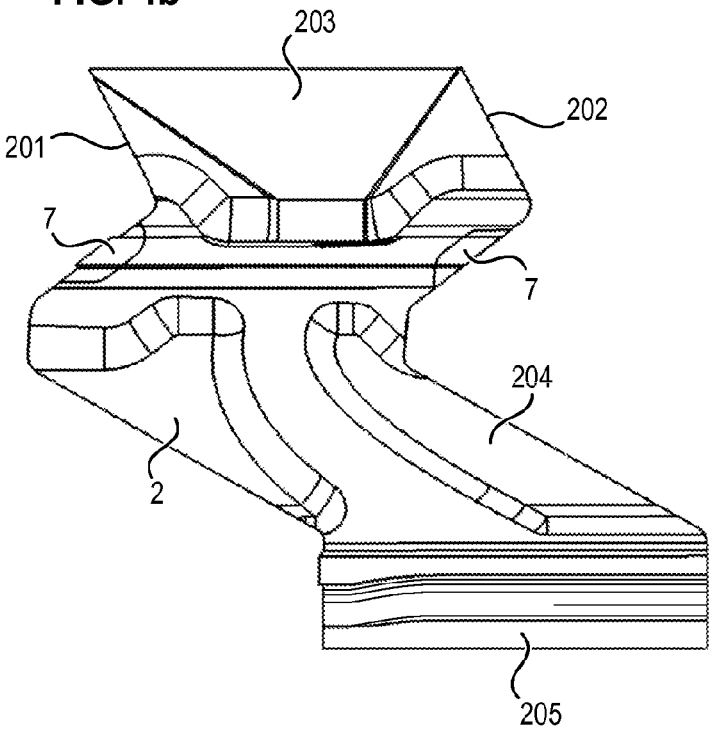
FIG. 4*b* shows a view along a radial axis of the heel of a rotor blade of a turbomachine after application to the rough part of FIG. 5*a* of a method according to an example of an embodiment of the invention.

Referring to FIGS. 2 to 5*c*, an example of a rotor blade of a turbomachine. Such a blade can for example be a blade of an airplane turbojet, for example at a low-pressure stage.

The blade includes a lower side and an upper side positioned on either side of a stacking axis. The blade can thus include an airfoil 101 extending along a stacking axis of the blade. The airfoil 101 extends between a proximal end 102 and a distal end 103 of the blade.

The blade includes a root 104 at its proximal end 102, by which it is for example attached to a disc of the rotor of the turbomachine. The disc can drive the blade in rotation about an axis of the turbomachine.

Heel

The blade has at its distal end 103 a heel 105. The heel 105 can be made in such a manner that, when several movable blades are attached to a rotor disc, their heels 105 are set edge to edge so as to form a rotating ring delimiting a surface of revolution about an axis of rotation of the blades. This ring has in particular the function of delimiting an outer surface of a passage for the gas flow circulating between the airfoils 101 and thus to limit possible gas leaks at the distal end 103 of the blades.

The heel 105 includes a platform 2 having a first edge 201 on the lower side and a second edge 202 on the upper side. The first and second edges 201 and 202 are for example opposite lateral edges. The platform 2 can delimit on the outside the gas flow passage circulating between the blades 101.

Seal Lip

The heel 105 includes at least one seal lip 3. The seal lip 3 has a first end portion 301 on the lower side and a second end portion 302 on the upper side. The seal lip 3 has a seal lip top extending radially outward from said platform 2 between said first 301 and second 302 end portions. The heel 105 can include an upstream seal lip 3 and a downstream seal lip 4, upstream and downstream being defined according to the direction of gas flow. The upstream 3 and downstream 4 seal lips can be made in such a manner that, when several movable blades are attached to a rotor disc, the seal lips 3 and 4 of the blades are set edge to edge so as to form a rotating ring along the axis of rotation of the blades, this ring being contained substantially within a radial plane. Such a ring makes it possible to limit the existing clearance between the blades and a stator, or a stator shroud, which surrounds them, so as to limit possible gas leaks at this location.

The part of the platform 2 extending upstream of the upstream seal lip 3 constitutes an upstream portion 203 or upstream spoiler. The portion of the platform 2 extending downstream of the downstream seal lip 4 constitutes a downstream portion 205 or downstream spoiler. Between the upstream portion 203 and the downstream portion 205, the platform 2 has a central part 204 extending between the upstream 3 and downstream 4 seal lips.

For the purpose of damping vibrations to which the blades are subjected in operation, the blades can be mounted on their rotor disc with a torsional stress about their stacking axis. Thus, the platforms 2 can be dimensioned in such a manner that each blade is given a torsional stress by pressing against its neighbors at the heels 105, mainly along the end portions of the seal lips 3 and 4.

Portion Forming a Cup

For at least one seal lip 3, for example for each seal lip 3, the heel 105 includes, at one of its edges 201 and 202 at least, a portion forming a cup 5 extending along the end portions 301 or 302 of the seal lip 3 which corresponds to the edge 201 or 202, the portion forming the cup 5 being designed to receive a deposit of anti-wear material 7. Thus, the heel 105 can include, for at least one seal lip 3, for example for all seal lips 3, at the first 201, respectively second 202 edge, a first, respectively second portion forming a cup 5 extending along the first 301, respectively second 302 end portion of the seal lip 3, the first, respectively second portion forming a cup 5 being designed to receive a deposit of an anti-wear material 7. Compared to the prior art, the portion forming the cup 5, along an end portion 301 or 302 of the seal lip 3, allows stiffening of this seal lip 3 and therefore to better withstand the loads caused by contact with adjacent heels 105. The referred figures represent portions forming a cup 5 at the upstream seal lip 3, but such portions forming cups 5 can be present, alternatively or complementarily, at the downstream seal lip 4.

Each portion forming a cup 5 can include two walls 501 and 502 extending on either side of the end portion of the corresponding seal lip 3. These walls thus form two faces 501 and 502 forming lateral walls of the cup 5 and the end portion of the seal lip 3 forms the bottom of the cup 5. These walls 501 and 502 can be reworked during subsequent machining.

Deposit of Anti-Wear Material

Thus the blade can include a layer of anti-wear material 7 deposited in each cup 5 thus formed. The [material] constituting the blade generally has poor resistance to wear and the anti-wear material makes it possible to extend its lifetime by protecting the parts subjected to wear.

The layer of anti-wear material 7 can be obtained by brazing plates of a specific alloy with high hardness to the cups 5.

The layer of anti-wear material 7 can be obtained by loading this lateral face with a melted alloy. The necessary heat can for example come from an electric arc sheathed with neutral gas or even from a laser beam. The anti-wear material 7 can be a cobalt-based alloy, for example an alloy of cobalt, chromium tungsten and carbon, for example such an alloy of the type of those marketed under the brand name "Stellite," having good anti-wear properties. The anti-wear material 7 can also be made on a rough blade from the foundry prior to machining, by Stelliting. The presence of the cup 5 in the seal lip 3 makes it possible to deposit a small quantity and without any risk of overflowing. Indeed, the portion forming the cup 5 acts like a "gutter" during deposit of the melted material, overflow being limited by the edges of the cup 5. The edges of the walls of the cup 5 extending past the anti-wear material deposited can then be removed during subsequent machining allowing the machined blade of being obtained.

The walls 501 and 502 of the cup portion 5 must thus have sufficient thickness to not melt completely during depositing of the melted anti-wear material. Their condition after depositing can however be modified during machining. Thus a thickness of 1.5 mm for the walls 501 and 502, for example, is sufficient. Likewise, the deposit of anti-wear material 7 does not need to have imperfections because the form of the layer can be modified during subsequent machining and possible subsequent sanding.

Such a blade also allows depositing of Stellite along the seal lip 3, which provides a greater lifetime for the blade because the areas protected by the anti-wear material 7 are supported on the seal lip 3. Moreover, such a blade allows automated depositing of anti-wear material and no longer requires any manual operation. As the material distributes itself along the cup 5, it is thus easier to accomplish a deposit of a small quantity of material. It is thus possible to obtain, after machining, a layer of anti-wear material 7. The layer of anti-wear material 7 has for example a thickness of 1 mm or a greater thickness.

Moreover, such a blade does not require a subsequent checking stage, the portion forming a cup 5 avoiding any overflow and the final form of the portion being obtained after machining. The result is a simplification of the method for depositing the anti-wear material, and more generally of the method of manufacture of rotor blades for a turbomachine.

Example Method

Figure 5A:
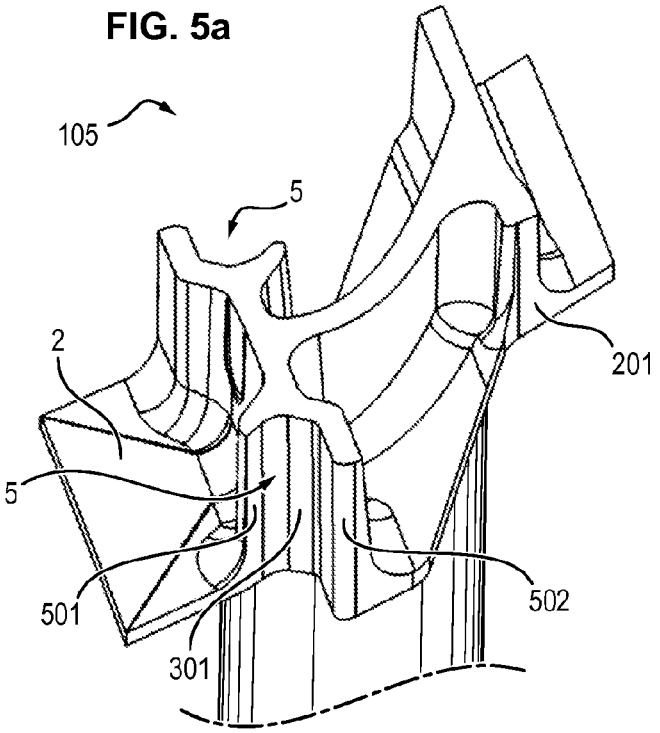
FIG. 5*a* shows a perspective view of the heel of FIG. 4*a*.
Figure 5B:
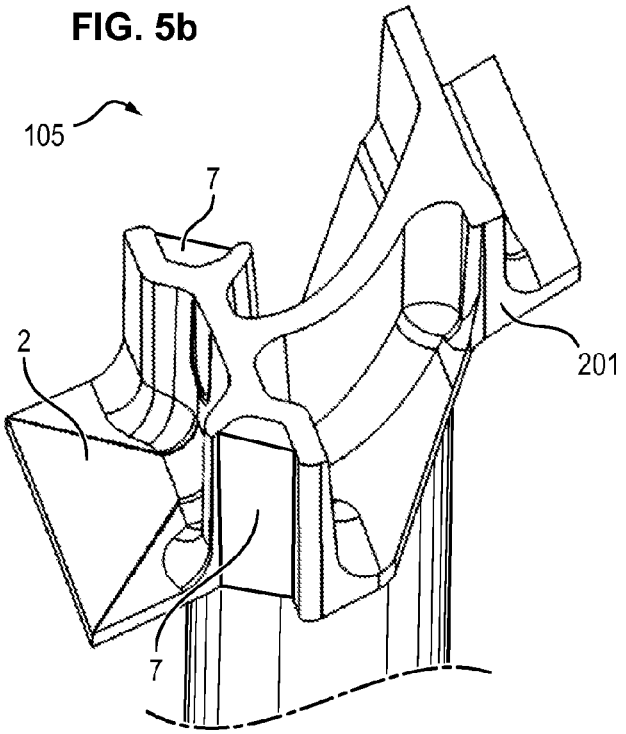
FIG. 5*b* shows a perspective view of the heel of FIG. 5*a* after deposit of the anti-wear material.
Figure 5C:
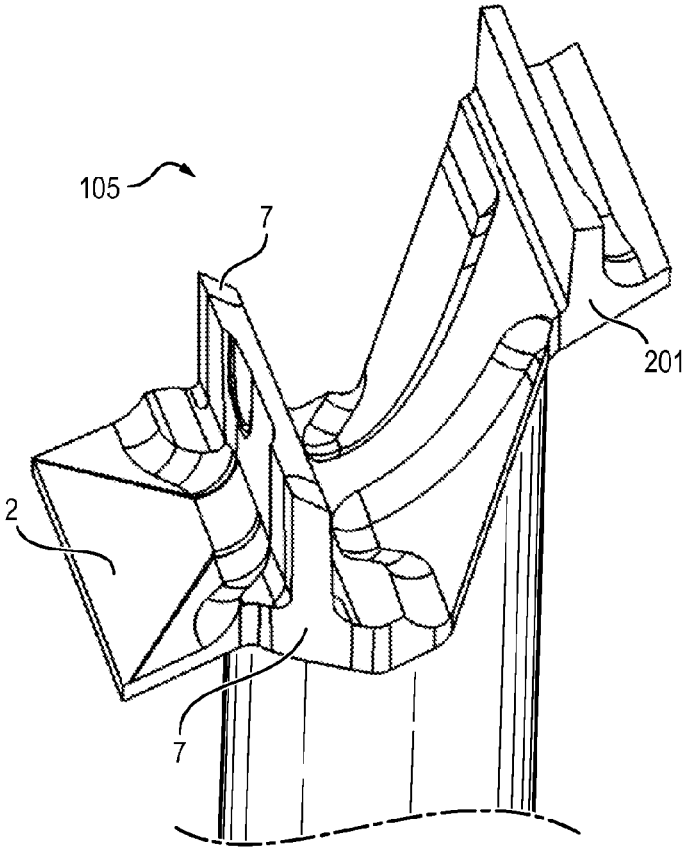
FIG. 5*c* shows a perspective view of the heel of FIG. 5*b* after machining and sanding.
Figure 6:
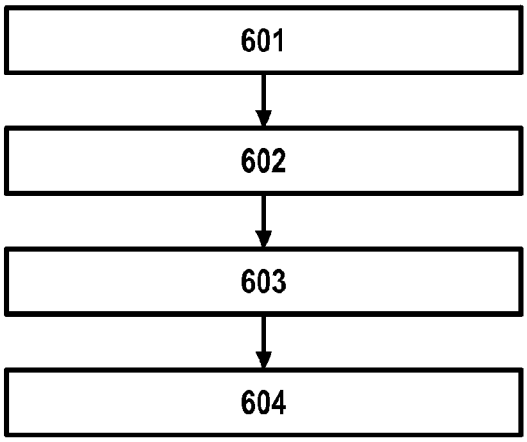
FIG. 6 shows in the form of a diagram of the method according to one example of an embodiment of the invention.

Referring to FIG. 6, a method for depositing anti-wear material on a rotor blade of a turbomachine is described there. The method includes a first step 601 consisting of supplying a rough rotor blade for a turbomachine as describe above and as shown in FIG. 5*a*. The method includes a second step consisting of depositing a layer of anti-wear material 7 as described above in each cup 5 formed, to obtain a heel 105 as shown in FIG. 5*b*. The method includes a third step 603 consisting of machining the edges of the walls 501 and 502 of the cup 5 extending past the layer of anti-wear material 7 deposited, so as to obtain a machined blade as shown in FIG. 5*c*.

The method can include a fourth step 604 consisting of sanding the surface of the layer of the anti-wear material 7 and of the portion forming a cup 5 after machining, so as to make them smooth.

The invention claimed is:

1. A rotor blade for a turbomachine, said blade having at its distal end (103) a heel (105) including:

a platform (2) having a first edge (201) on the lower side and a second edge (202) on the upper side, at least one seal lip (3) having a first end portion (301) on the lower side and a second end portion (302) on the upper side, said seal lip (3) having a seal lip top extending radially outward from said platform (2) between said first and second end portions (301, 302), wherein, for at least one seal lip (3) the heel (105) includes at one of the edges (201, 202) at least one portion forming a cup (5) extending along the end portion (301, 302) of the seal lip (3) which corresponds to the edge (201, 202), the portion forming a cup (5) designed to receive a deposit of an anti-wear material (7), and in that the at least one portion includes a layer of antiwear material (7) deposited by loading a melted alloy into each cup (5) thus formed, wherein each portion forming a cup (5) includes two lateral walls (501, 502) extending on either side of the end portion (301, 302) of the corresponding seal lip (3), which lateral walls extending on either side of the seal lip form lateral walls of the cup and the end portion (301, 302) of the seal lip (3) forms the bottom of the cup (5).

2. The rotor blade according to claim 1, wherein the heel (105) includes, for at least one seal lip (3), at the first (201) respectively second (202) edge, a first, respectively second portion forming a cup (5) extending along the first, respectively second, end portion (301, 302) of the seal lip (3), the first, respectively second portion forming a cup (5) being designed to receive a deposit of anti-wear material (7).

3. The rotor blade according to claim 1, including an upstream seal lip (3) and a downstream seal lip (4).

4. The rotor blade according to claim 1, wherein the anti-wear material is a cobalt-based metal alloy.

5. The rotor blade of a turbomachine according to claim 1, wherein the blade is a rough blade part prior to machining.

6. The rotor blade of a turbomachine according to claim 1, wherein the blade is a machined blade.

7. The rotor blade according to claim 1, wherein the anti-wear material extends on the whole height of the seal lip.

8. A method for depositing anti-wear material on a rotor blade of a turbomachine, comprising:

supplying a rough part of a rotor blade of a turbomachine prior to machining, said part having at its distal end (103) a heel (105) including:

a platform (2) having a first edge (201) on the lower side and a second edge (202) on the upper side, at least one seal lip (3) having a first end portion (301) on the lower side and a second end portion (302) on the upper side, said seal lip (3) having a seal lip top extending radially outward from said platform (2) between said first and second end portions (301, 302), such that, for at least one seal lip (3), the heel (105) includes at one of the edges (201, 202) at least one portion forming a cup (5) extending along the end portion (301, 302) of the seal lip (3) which corresponds to the edge (201, 202), the portion forming a cup (5) being designed to receive a deposit of anti-wear material (7), wherein each portion forming a cup (5) includes two lateral walls (501, 502) extending on either side of the end portion (301, 302) of the corresponding seal lip (3), which lateral walls extending on either side of the seal lip form lateral walls of the cup and the end portion (301, 302) of the seal lip (3) forms the bottom of the cup (5), depositing a layer of anti-wear material (7) by loading with a melted alloy into each cup (5) formed, and machining lateral walls (501, 502) of the cup (5) extending past the layer of anti-wear material (7) deposited.

9. The method according to claim 8, further comprising after said machining, sanding the surface of the layer of anti-wear material (7) and the lateral walls.

* * * * *